US007270252B2

(12) United States Patent
Hunt et al.

(10) Patent No.: US 7,270,252 B2
(45) Date of Patent: Sep. 18, 2007

(54) GARMENT HANGER

(75) Inventors: William Joseph Hunt, Buckinghamshire (GB); Christopher Barlow, London (GB)

(73) Assignee: Braitrim (UK) Limited, London (GB)

( * ) Notice: Subject to any disclaimer, the term of this patent is extended or adjusted under 35 U.S.C. 154(b) by 130 days.

(21) Appl. No.: 10/498,243

(22) PCT Filed: Dec. 11, 2002

(86) PCT No.: PCT/GB02/05616

§ 371 (c)(1),
(2), (4) Date: Oct. 7, 2004

(87) PCT Pub. No.: WO03/051160

PCT Pub. Date: Jun. 26, 2003

(65) Prior Publication Data

US 2005/0035159 A1 Feb. 17, 2005

(30) Foreign Application Priority Data

Dec. 14, 2001 (GB) ..... 0129972.6

(51) Int. Cl.
*A41D 27/22* (2006.01)

(52) U.S. Cl. ..... 223/95

(58) Field of Classification Search ..... 223/85–98
See application file for complete search history.

(56) References Cited

U.S. PATENT DOCUMENTS

| | | | | | |
|---|---|---|---|---|---|
| 3,024,954 | A | * | 3/1962 | Michlin | 223/95 |
| 3,831,925 | A | * | 8/1974 | Nakamura et al. | 267/156 |
| 5,397,038 | A | * | 3/1995 | Hunt | 223/95 |
| 5,664,710 | A | * | 9/1997 | Lam | 223/94 |
| 6,158,634 | A | * | 12/2000 | Kelroy | 223/89 |

FOREIGN PATENT DOCUMENTS

| | | |
|---|---|---|
| DE | 17 53 615 | 11/1971 |
| EP | 0 482 509 | 4/1992 |
| GB | 2 304 563 | 3/1997 |

* cited by examiner

*Primary Examiner*—Shaun R. Hurley
(74) *Attorney, Agent, or Firm*—Timothy J. Keefer; Seyfarth Shaw LLP

(57) ABSTRACT

A garment hanger has a body 1 with a longitudinal axis. A movable first arm 2 is slidably mounted on the body for free movement with respect to the body substantially along the longitudinal axis. A constant or decreasing force spring 4 applies a resilient force to the first arm to urge the first arm outwards of the body so that the first arm is able to move between a retracted position and an extended position relative to the body. The resilient force exerted by the garment hanger remains substantially constant or increases between a fully retracted position and a fully extended position.

40 Claims, 16 Drawing Sheets

Fig. 5

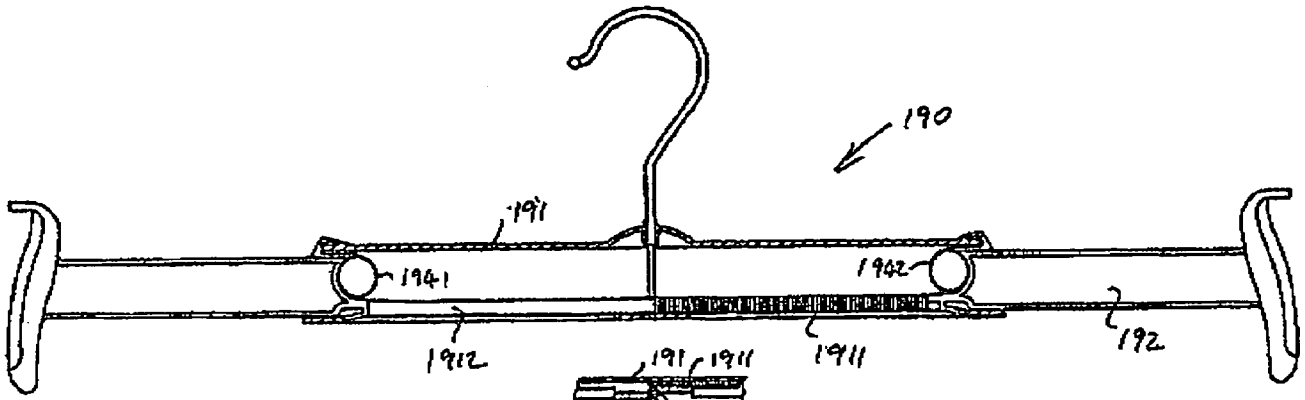
Fig. 19
Fig. 19A
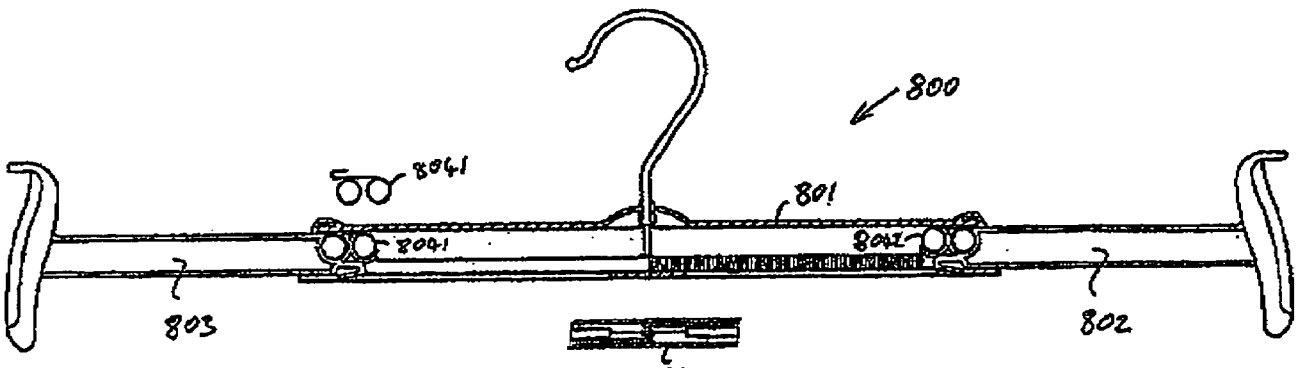
Fig. 20
Fig. 20A 200
52
520
521
522
523
524
54
55
40
41
201
222
216
225
227
224
223
203
214
212
211
213
51
215
221
231
232
242
241

GARMENT HANGER

BACKGROUND OF THE INVENTION (1) Field of the Invention

This invention relates to a garment hanger.

(2) Description of the Related Art

Garment hangers in which the outer ends are intended to grip waistbands of garments such as trousers and skirts are well known.

Extendible garment hangers are also known in which arms of the hanger are of variable length to support different sizes of garment on the hanger. Such hangers conventionally fall into two types.

In a first type, which might be typified by that shown in European Patent No. 0386080, two hanger arms are mounted in a body for simultaneous slidable movement in opposite directions relative to each other. The arms are moved manually sufficiently far apart to grip the waistband and then the arms are locked in position with a locking mechanism.

A disadvantage of this type of hanger is that loading operators often over-stretch the waistband material when placing a garment on the hanger. This is because the hanger provides no indication of the appropriate force necessary for retention of garments on the hanger.

In a second type, two arms are slidably mounted on a hanger body for free movement in opposite directions relative to each other and under the action of a compression spring the arms are caused to move outward of the body so that the arms are able to assume positions between a retracted position and an extended position relative to the body to grip the waistband of the garment.

Various cross-sections of part of an arm of such a known extendible garment hanger 100 are shown in FIGS. 1 to 4, in which a body 101 has a longitudinal inverted U-shaped channel 110 for receiving a moveable telescoping arm 120 of I-shaped cross-section. It will be understood that the moveable arm is moveable relative to the body. A coiled compression spring 130 is contained within an upper portion 111 of the channel 110 supported by elongate protrusions 112,113 on inner surfaces of walls of the channel. A first end of the compression spring 130 bears on a stop (not shown) located substantially central of the hanger and an opposed second end of the spring bears on an inner stepped end 121 of the arm 120 to urge the arm outward of the body 101. The arm is provided with a resilient outward facing tab 122 dependent from a lower face of the arm proximate an inner end of the arm to engage an inner end 121 of a rectangular channel portion 131 of the channel 110 proximate an outer end of the body 101, to restrict outward movement of the arm.

A disadvantage with the above described garment hanger is that increasing force is necessary progressively to compress the spring so that, conversely, the spring exerts a decreasing force on the arm 120 as the arm is extended. In order to provide an extension garment hanger which exerts sufficient lateral force on the arm to support a first garment, excessive force may be required to compress the spring to support a second garment smaller than the first garment. Moreover, the garment hanger may exert excessive force on the smaller second garment. That is, a gripping force exerted by the arms on the waistband when they are fully extended is significantly less than a gripping force exerted by the arms on the waistband when they are fully retracted, but in this latter position for gripping the narrowest waistbands the force exerted may be so great as to damage the garment. This is the opposite of what is often required, in that a larger gripping force may be required to support a larger size garment with the hanger arms extended than is needed to support a smaller size garment with the arms retracted.

In general the desirable gripping force supplied by a compression spring in order to hold a garment securely but without damaging the garment is achievable over only a limited width of arm extension. Consequently, it is essential to provide varying widths of hangers of one particular design to accommodate all the required waistband sizes.

Moreover, the spring 130 can become coil bound within the channel 110.

EP 482 509 A discloses expandable garment hangers with a spring in which a force exerted on the arms, and therefore by the garment hanger on a garment, decreases as the hanger is expanded or without any spring and with or without a locking mechanism to lock the arms of the garment hanger in differently expanded positions.

DE 1 753 615 B discloses a garment hanger having two constant force springs housed at outer opposed ends of a body of the hanger, with extendible ends of the springs acting on inner ends of extendable arms. No means of moving the arms in synchronisation is disclosed.

It is an object of the present invention at least to ameliorate the aforesaid disadvantages of the prior art.

BRIEF SUMMARY OF THE INVENTION

According to the present invention, there is provided a garment hanger comprising a body having a longitudinal axis, a movable first arm slidably mounted on the body for free movement with respect to the body substantially along the longitudinal axis, means for applying a resilient force to the first arm to urge the first arm outwards of the body so that the first arm is able to move between a retracted position and an extended position relative to the body wherein the resilient force remains substantially constant or increases between the retracted position and the extended position.

Preferably the means for applying a resilient force to the first arm comprises a first constant or decreasing force spring located in the body, wherein a resilient force created by the spring remains constant or decreases respectively as the spring is extended.

Advantageously, the first arm includes a first garment-engaging portion located at an outer end of the first arm for supporting a garment thereon.

Preferably, there is provided a second arm mounted on the body for slidable movement along the longitudinal axis in an opposed direction relative to the first arm.

Advantageously, the second arm includes a second garment-engaging portion located at an outer end of the second arm for supporting the garment by the first garment-engaging portion and the second garment-engaging portion.

Conveniently, the first spring is located in a housing in the body with a leading end of the first spring secured to the first arm such that a tendency of the spring to recoil urges the arm outward of the body.

Preferably, the first and second arm each include a respective toothed portion engagable with a common centrally located gear wheel rotatably mounted in the body such that movement of the first arm in a first direction moves the second arm in a second direction opposed to the first direction and the first and second arms move in opposite directions simultaneously.

Conveniently, the gear wheel has an axis substantially perpendicular to a front and/or rear face of the hanger body.

Alternatively, the gear wheel has an axis substantially perpendicular to a top and/or bottom face of the hanger body.

Conveniently, a second constant or decreasing force spring is arranged to act together on the second arm with the first spring, and the first and second springs are spaced apart in at least one housing in the body.

Alternatively, the hanger is further provided with a second constant or decreasing force spring such that the first constant or decreasing force spring acts directly on the first arm and the second constant or decreasing force spring acts directly on the second arm.

Advantageously, the first constant or decreasing force spring is contained in a first housing in the body and the second constant or decreasing force spring is located in a second housing in the body.

Conveniently, the first housing is dependent from a lower face of the body proximate a first end of the body and the second housing is dependent from the lower face of the body proximate an opposed second end of the body.

Alternatively, the first housing is dependent from a lower face of the body proximate a first end of the body and the second housing is dependent from the lower face of the body proximate a centre of the body.

Alternatively, the first housing is dependent from a lower face of the body proximate a first end of the body and the second housing rises from an upper face of the body proximate an opposed second end of the body.

Advantageously, a leading end of the first spring is anchored to the body and the first spring comprises a coilable portion having a coil axis substantially perpendicular to the longitudinal axis at a second end of the first spring opposed to the leading end, such that the coilable portion bears on an inner end of the first arm to urge the first arm outward of the body.

Conveniently, respective leading ends of first and second constant or decreasing force springs are anchored to the body each spring comprising a coilable portion having a coil axis substantially perpendicular to the longitudinal axis at second ends of the constant or decreasing force springs opposed to the leading ends, such that the coilable portions bear on faces of spaced apart coil housings located in the first arm to urge the first arm outward of the body.

Advantageously, the body comprises a longitudinal channel communicating with an open end of the body for receiving the first arm; such that the first arm is telescopable into the channel and the constant or decreasing force spring is at least partially located within the channel.

Conveniently, the free end of the constant or decreasing force spring is connected to the body proximate the open end.

Preferably, the free end of the constant or decreasing force spring comprises hook means for hooking onto the open end.

Conveniently, the hook means is 'U'-shaped.

Advantageously, the inner end of the first arm is at least partially arcuate transversely to said longitudinal axis to receive a convex outer surface of the coilable portion.

Preferably, the constant or decreasing force spring comprises a coiled spring in which a number of turns of the spring is dependant on extension of the spring.

Advantageously, leaves of the decreasing force spring are transversely arcuate with varying radius along a length of the spring such that a resilient force exerted by the spring decreases as the spring is extended.

Advantageously, the coilable portion of the constant or decreasing force spring comprises a plurality of interleaved lamina, the plurality of lamina not being interconnected except insofar that they are anchored to the same location, such that each of the plurality of lamina may slip over a neighbouring lamina as they are coiled and uncoiled.

Preferably, the garment hanger includes a second arm opposed to the first arm.

Preferably, the second arm is at least a partial mirror image of the first arm.

Conveniently, the body is in two parts, a rear part on which the arm or arms and the means for applying a resilient force are mounted and a front part which is securable to the rear part.

Preferably the body has a hook for suspending the hanger from a rail.

BRIEF DESCRIPTION OF THE SEVERAL VIEWS OF THE DRAWINGS

Specific embodiments of the invention will now be described by way of example with reference to the accompanying drawings, in which:

FIG. 19 shows a vertical cross-section view of a seventh embodiment of a garment hanger according to the present invention;

FIG. 19A shows a horizontal cross-section view of a central portion of the hanger of FIG. 19;

FIG. 20 shows a vertical cross-section view of an eighth embodiment of a garment hanger according to the present invention;

FIG. 20A shows a horizontal cross-section view of a central portion of the hanger of FIG. 20;

In the description like reference numerals denote like parts.

DETAILED DESCRIPTION OF THE INVENTION

Figures 1, 2, 3, 4:
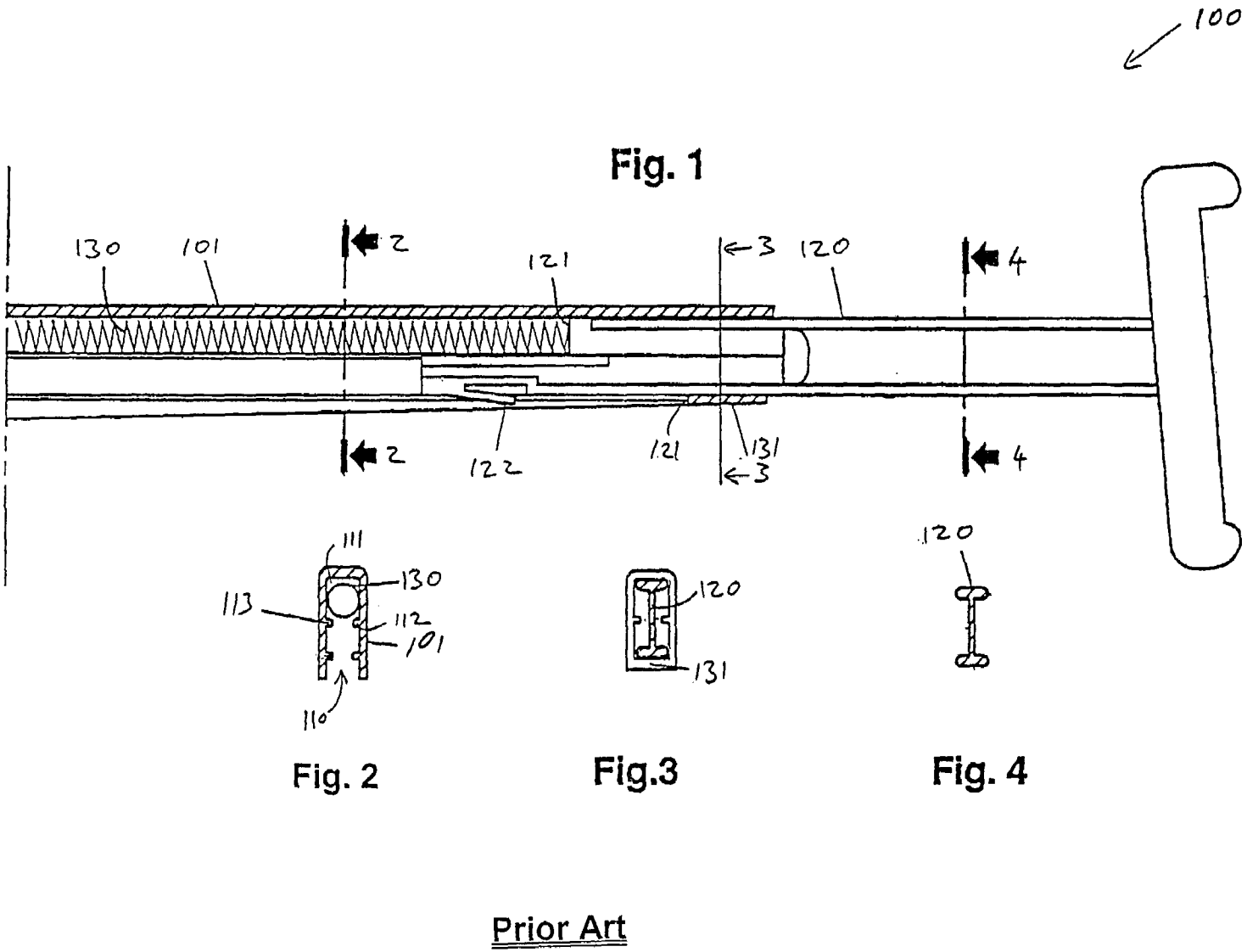
Fig. 2 Prior Art
FIG. 1 shows a longitudinal vertical cross-section of a portion of an arm of a prior art hanger.
FIG. 2 shows a transverse vertical cross-section along line 2-2 of FIG. 1.
FIG. 3 shows a transverse vertical cross-section along line 3-3 of FIG. 1.
FIG. 4 shows a transverse vertical cross-section along line 4-4 of FIG. 1.
Figure 5:
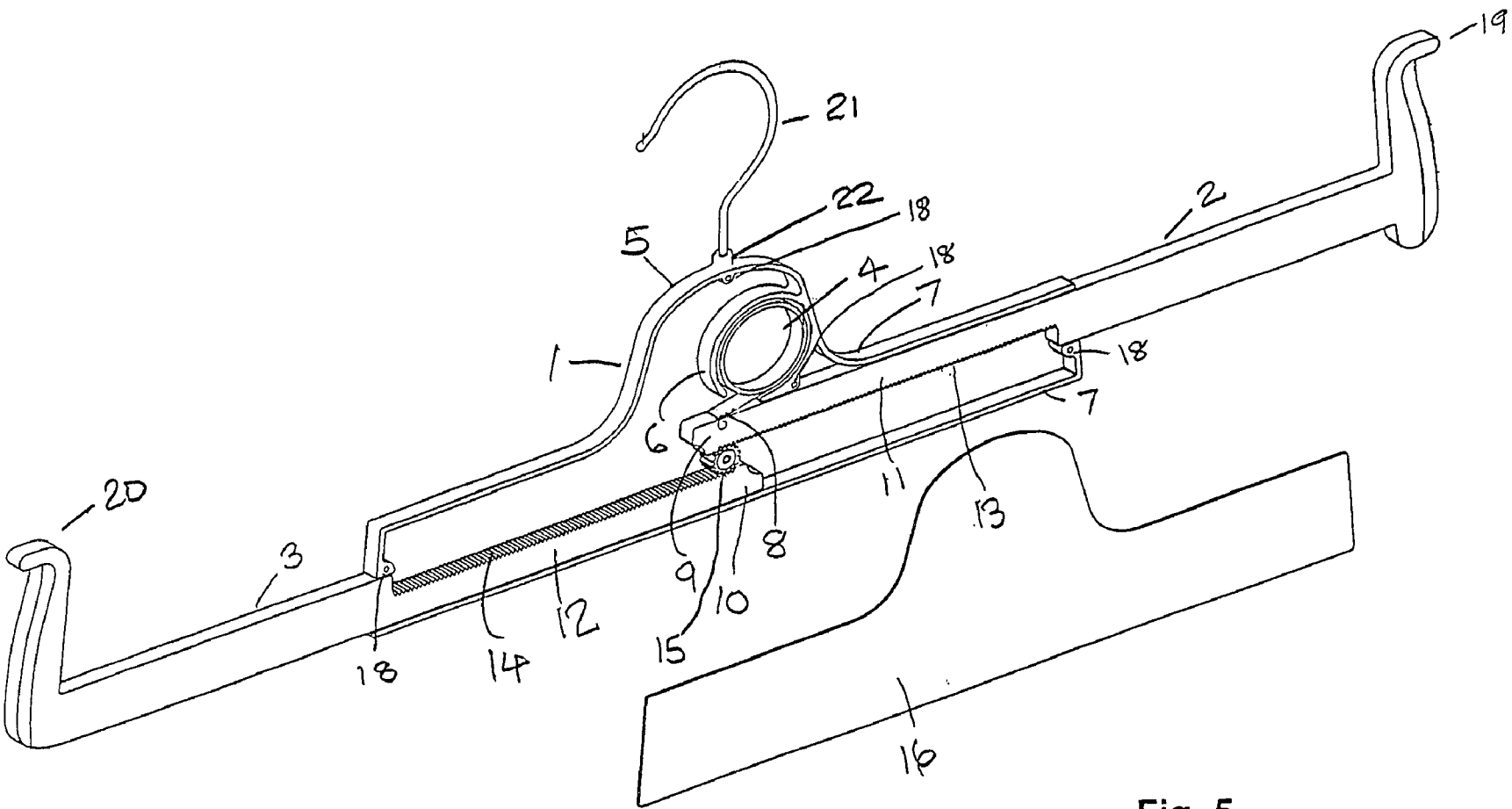
FIG. 5 shows a perspective view of a first embodiment of a hanger according to the invention with a front portion of the body removed from the hanger to clarify the view.

Referring to FIGS. 5 to 8, the garment hanger of a first embodiment of the present invention comprises a body 1, first and second moveable arms 2,3 slidably mounted on the body 1 for free movement and means in the form of a constant or decreasing force spring 4 for applying a resilient force to (in this case) the first arm 2 to cause the first arm 2 to be urged outward of the body 1.

The body 1 comprises a rear portion 5 to form a hollow chamber within which the first and second arms 2,3 are slidably mounted and within which the spring 4 is also mounted within a part-circular retaining cage 6. The rear portion 5 has a peripheral projecting wall 7 and the rear portion 5, the wall 7 and the cage 6 are all moulded together.

A leading edge 8 of the spring 4 is secured to an innermost body-located end 9 of the first arm 2, which in this case is uppermost of the first and second arms 2 and 3. An opposed end of the spring is not attached to the body so that the opposed end is free to rotate within the body as the leading edge is extended and retracted. The innermost ends 9 and 10 of each arm 2,3 have a part 11 and 12 of reduced height, on which is located a gear toothed portion 13 and 14 respectively, extending inwardly along each of the arms 2,3. A geared wheel 15 rotatably mounted centrally of the body rear portion 5 is engaged with each of the toothed portions 13 and 14. Consequently, movement in one direction of one of the arms 2,3 by reason of interaction between the respective gear toothed portion 13,14 and the wheel 15 moves the other arm in an opposite direction. The body 1 also has a generally flat front portion 16 in the form of a flap which matches the rear portion 5 and which is hingeably connected to the rear portion 5 and has a number of locating pins 17 (see FIG. 6) moulded thereto to engage in corresponding apertures 18 in the wall 7 and cage 6 of the rear portion 5.

Figure 6:
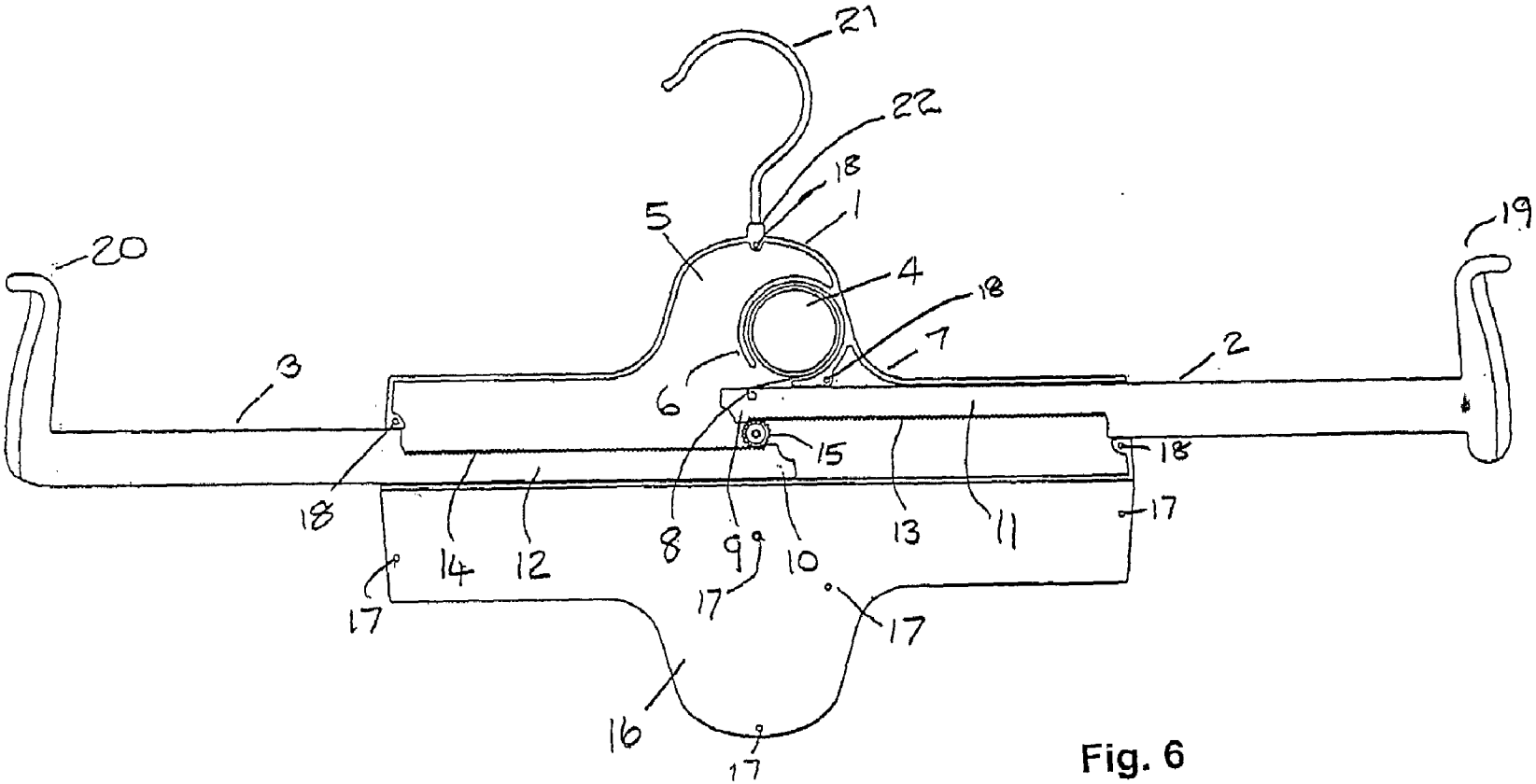
FIG. 6 shows a front view of the hanger of FIG. 5 with the front portion of the body disengaged from, but hingeably connected to, a rear portion of the body, the arms being shown in a fully extended position.
Figure 7:
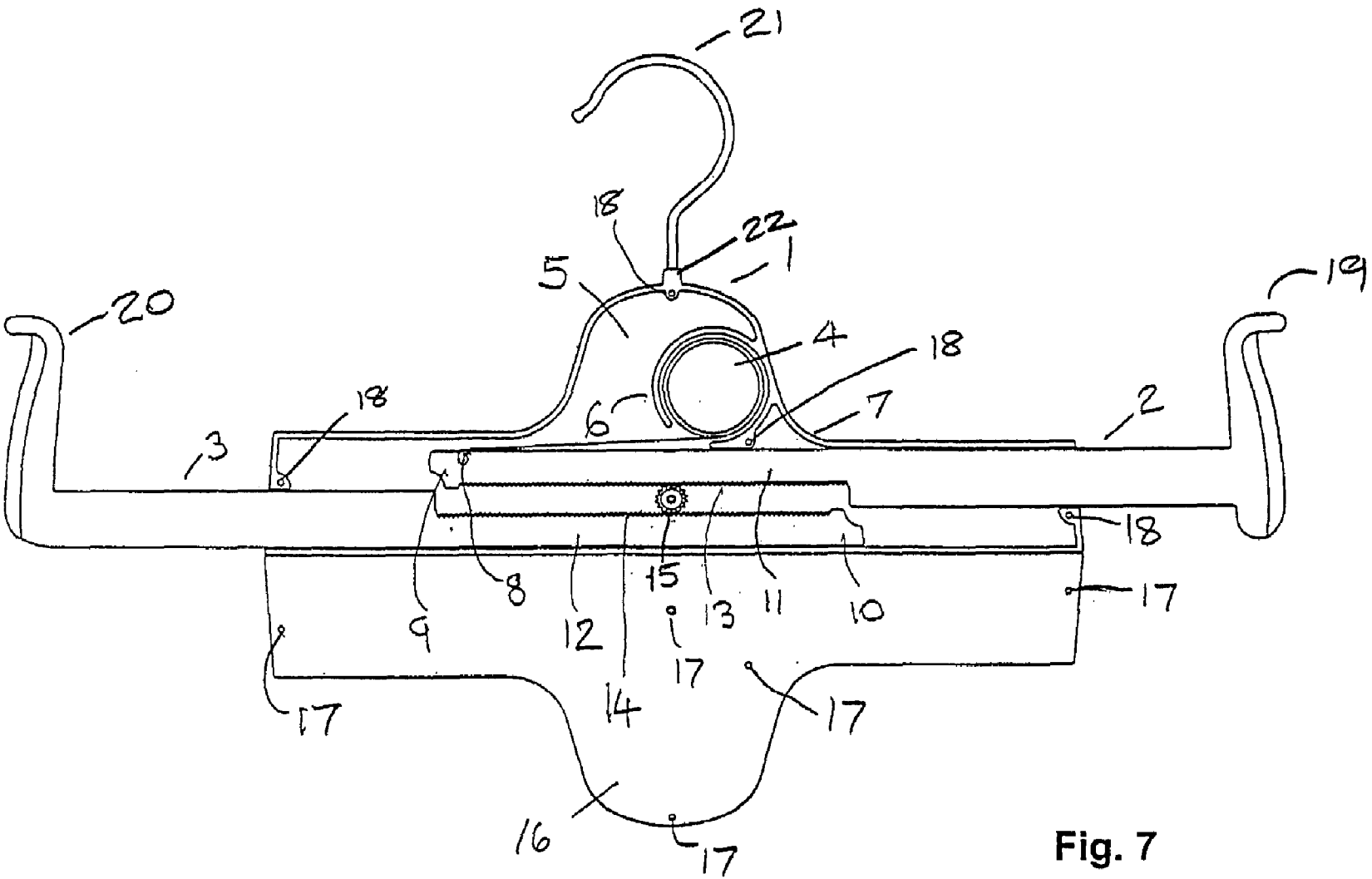
FIG. 7 shows a further front view of the hanger of FIG. 5 similar to FIG. 6 with the arms shown in a partially extended position.
Figure 8:
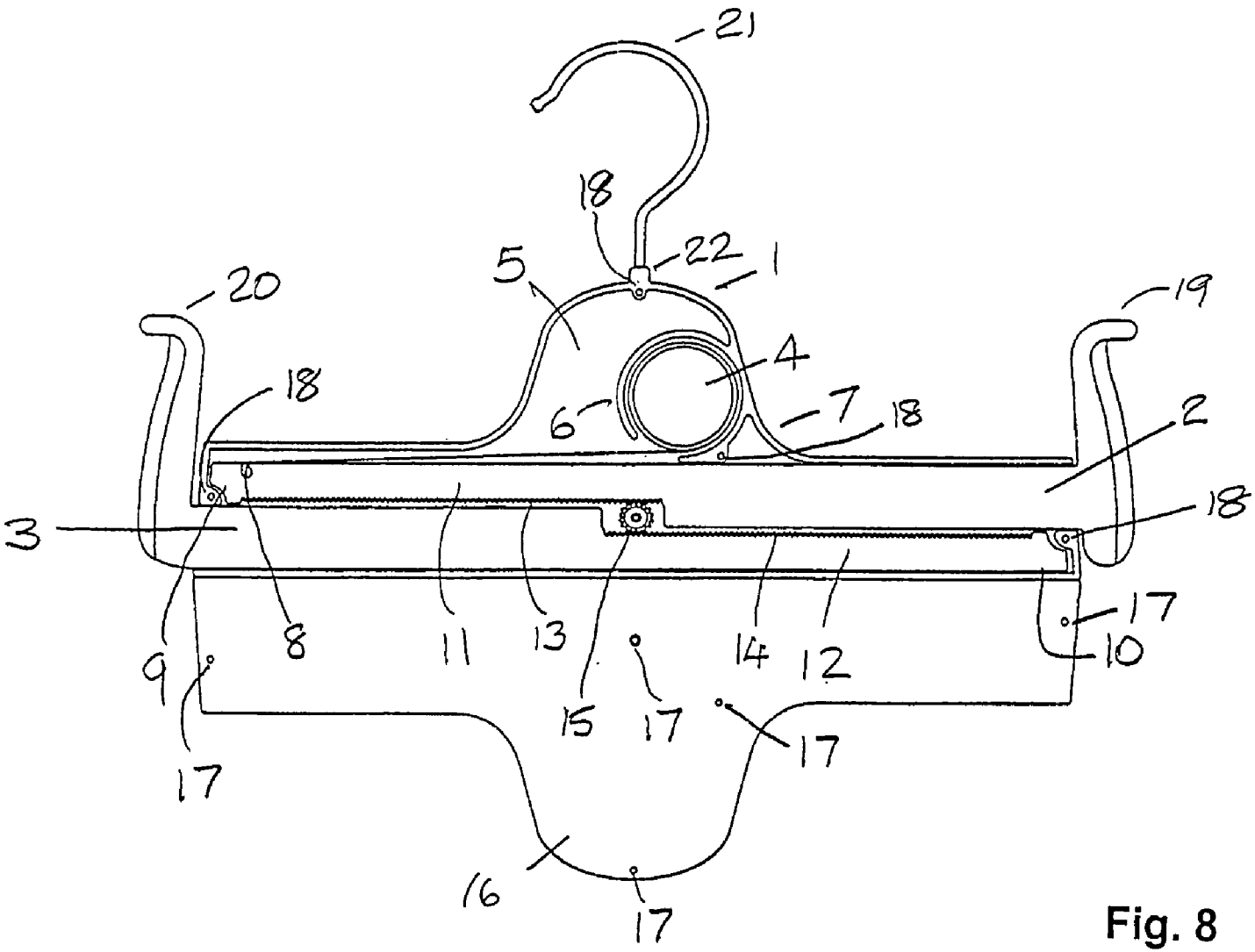
FIG. 8 shows another front view of the hanger of FIG. 5 similar to FIGS. 6 and 7 with the arms shown in a fully retracted position.
Figure 10:
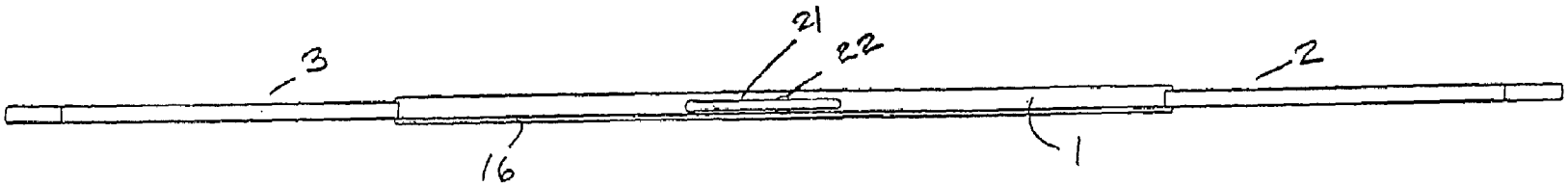
FIG. 10 shows a plan view of the hanger of FIG. 5.
Figure 11:
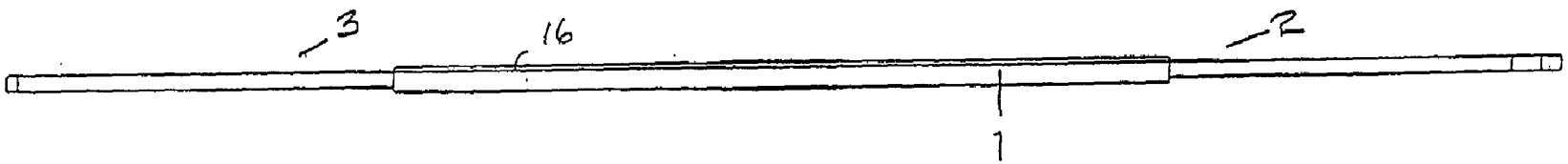
FIG. 11 shows an underneath view of the hanger of FIG. 5.

As shown in FIGS. 6 to 8 the front portion 16 can be released from the rear portion 5 from which the front portion 16 can then hang down to permit access to the arms, spring and gear wheel. The front portion 16 can then be raised and snap fitted into engagement with the rear portion 5 to cover components of the hanger as shown in FIGS. 10 and 11.

Each of the extreme outer ends of the first and second arms 2,3 is provided with a garment engaging or gripping portion 19,20 respectively which are angled relative to a longitudinal axis of the body 1 to prevent a garment slipping off the hanger in use.

The wall 7 of the body rear portion 5 is provided with a centrally located hook 21 for suspending the hanger, the hook 21 being rotatably mounted in a bush 22 moulded in the wall 7.

Figure 9:
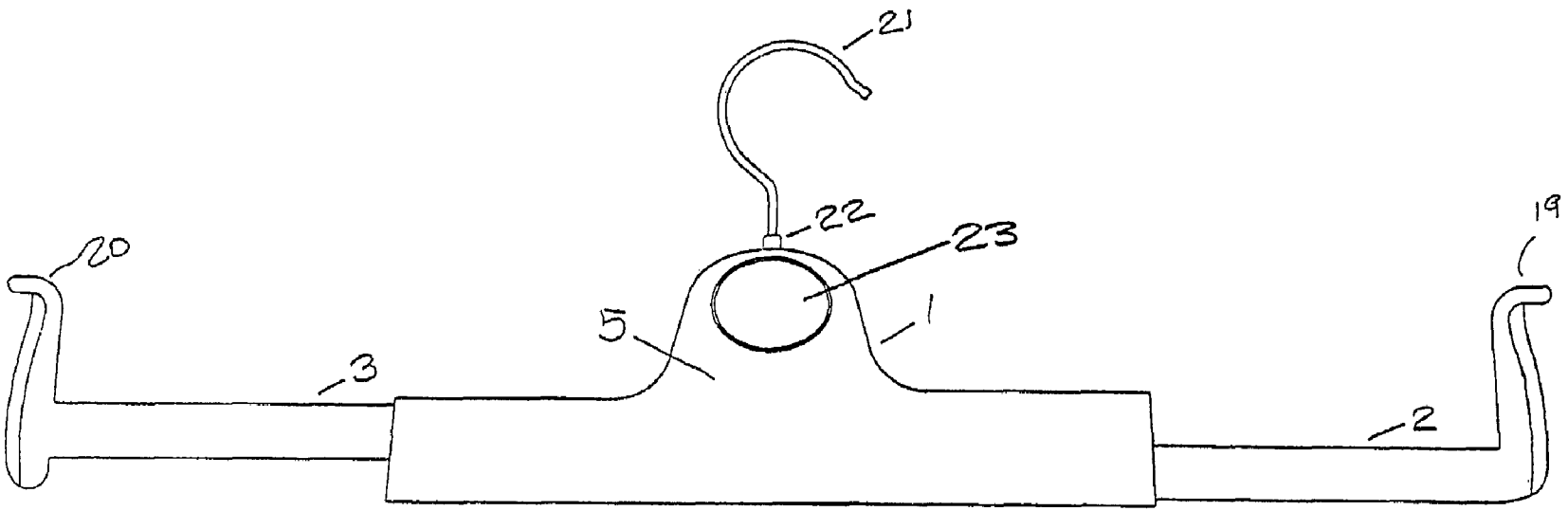
FIG. 9 shows a rear view of the hanger of FIG. 5.

As shown particularly in FIG. 9 the rear body portion 5 may be provided with an area 23 to which a brand name, clothing size or other information may be affixed.

Referring to FIGS. 5 to 8 again, in the normal relaxed state of the spring 4 the hanger will assume the position shown in FIGS. 5 and 6 with the arms 2,3 being fully extended at an outermost point relative to the body 1. A position where the hanger is to suspend garments of the widest waistband to be suspended may be just narrower than this fully extended width of the arms 2,3. By manually compressing the arms 2,3 inwards towards the body 1 against a force exerted by the spring 4 to the position shown in FIG. 7, garments of an intermediate waistband size can be suspended from the hanger by placing a waistband of the garment over the garment engaging portions 19,20 of the arms 2,3. On releasing the arms 2,3 the garment engaging portions 19,20 are urged into engagement with the garment waistband by the spring 4. By compressing the arms 2,3 further inwards towards the body 1 to the position shown in FIG. 8 where the arms 2,3 are fully retracted at an innermost point relative to the body 1, garments of a narrowest waistband to be suspended can be suspended from the hanger by the same process as is described in relation to FIG. 7.

In the case of a constant force spring 4, the hanger exerts the same force on a garment at any extension of the arms 2,3. In the case of a decreasing force spring, by which is to be understood a spring which exerts a decreasing resilient retracting force as the spring is extended, the spring exerts a greater force with the spring contracted and the arms extended than with the spring extended and the arms contracted. This means that the garment hanger desirably exerts a larger force on a larger and therefore heavier garment than on a smaller and therefore lighter, garment. A known means of producing a decreasing force spring is to tighten winding of the spring as the spring is wound into a coil during manufacture. Another known method is to introduce a transverse curvature into the spring leaf of a coil spring such that the curvature decreases from the leading edge of the spring towards the opposed coiled end of the spring. The curvature, and therefore the resilience, of a portion of the spring leaf which is straightened as the spring is extended therefore decreases as the spring is extended.

The use of a cogwheel to move the arms in opposed directions in unison ensures that the hook 21 remains central of the hanger as the arms are extended and retracted.

Figure 12:
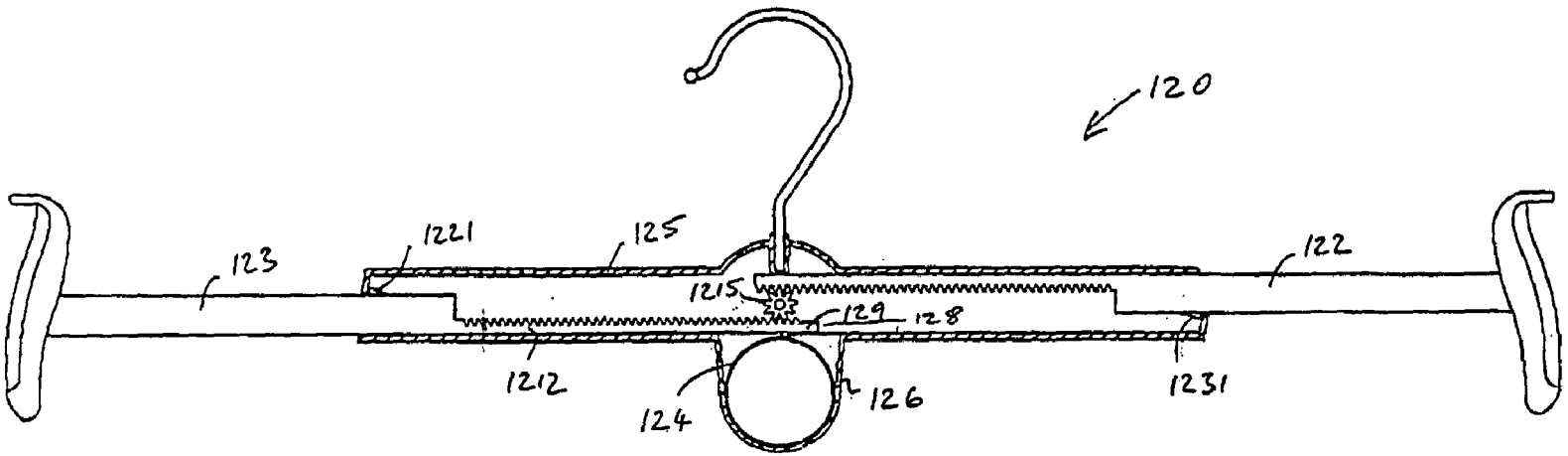
FIG. 12 shows a vertical cross-section view of a second embodiment of a garment hanger according to the present invention.

A second embodiment 120 of the invention, shown in FIG. 12, having a first arm 122 and a second arm 123 is similar to the first embodiment except that a housing 126 for a constant or decreasing force spring 124 is located beneath a centre of a body 125. The housing 126 is partially circular in vertical cross-section to accommodate a coiled portion of the spring 124 such that a portion of the outermost coil of the coiled portion bears on an inner face of the housing as the spring is extended by retracting the first and second arms 122, 123. A leading edge 128 of the spring 124 is secured to an innermost body-located end 129 of the second arm 123, which in this case is lowermost of first and second arms 122 and 123. A first resilient stop or tab 1221 is provided on an upper surface of the second arm 123 proximate a junction of a part 1212 of reduced height of the arm with the remainder of the second arm 123 such that the resilient stop 1221 is depressable into the second arm 123 for assembling the second arm 123 into the body 125 but subsequently resiliently extends above the upper surface of the arm to engage a wall of the body 125 when the second arm is fully extended, to prevent removal of the second arm 123 from the body 125. A corresponding second stop 1231 is provided on a lower surface of the first arm 122 to allow assembly of the first arm 122 into the body 125 and to prevent subsequent accidental removal of the first arm 122 from the body. It will be understood that since the two arms move in unison under the action of a central common cogwheel, one of the stops 1221, 1231 may alternatively be dispensed with.

Figure 13:
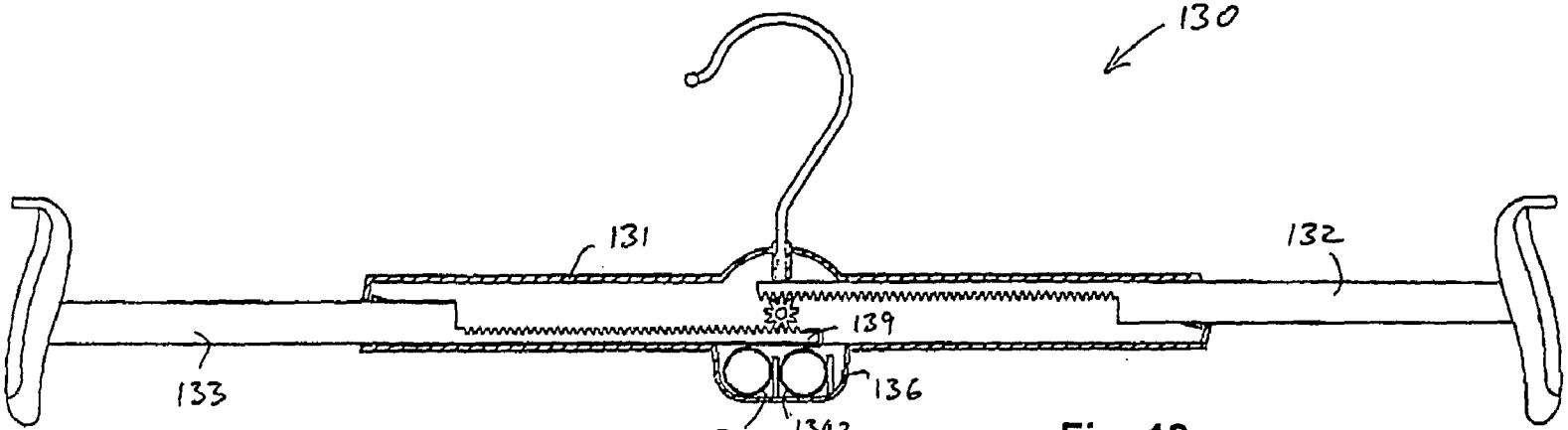
FIG. 13 shows a vertical cross-section view of a third embodiment of a garment hanger according to the present invention.

A third embodiment 130 of the invention, shown in FIG. 13, having a first arm 132 and a second arm 133, is similar to the second embodiment except that the single constant or decreasing force spring 124 of the second embodiment is replaced by two constant or decreasing force springs 1341, 1342 acting in tandem. That is, a divided housing 136 is provided central of the hanger and dependent from a body 131 having first and second compartments for housing the first spring 1341 and the second spring 1342 respectively. Leading edges of the two springs are both connected to an inner-most body-located end 139 of the second arm 133. Since the force exerted on the arms is shared by the first and second springs 1341, 1342 the force exerted by each of these springs is less than that of the single spring 124 of the previous embodiment so that the springs 1341, 1342 of the present embodiment may have a smaller diameter leading to a more compact hanger design. Although in this embodiment, the leading edges of both the hangers are shown fixed at a same point on the second arm 133, it will be apparent that alternatively the leading edges may be connected at separate points on the second arm. In other respects the third embodiment is the same as the second embodiment.

Figure 14:
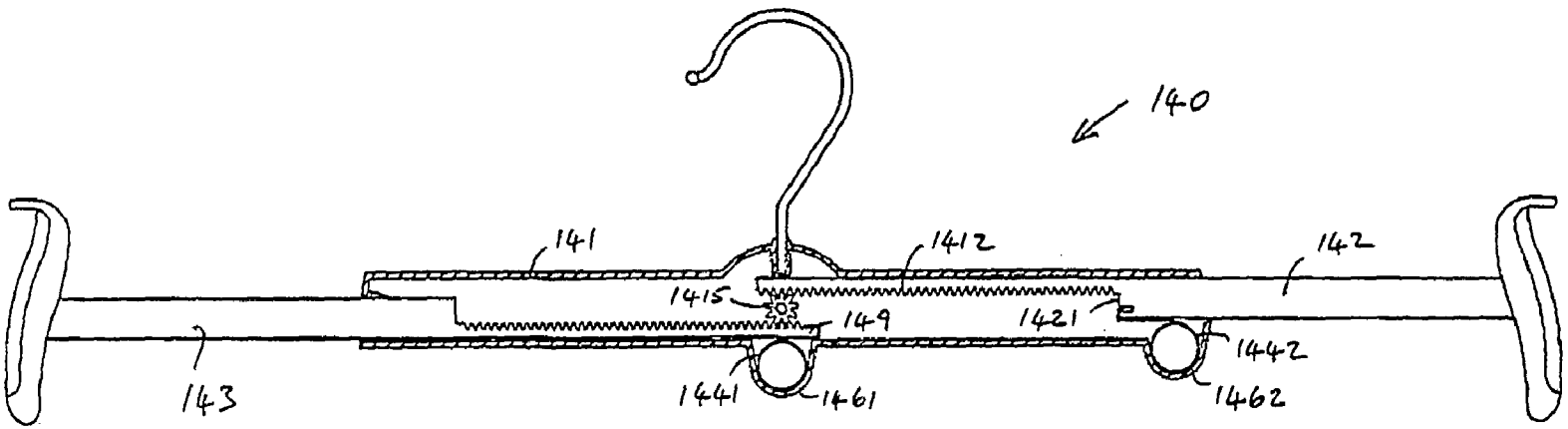
FIG. 14 shows a vertical cross-section view of a fourth embodiment of a garment hanger according to the present invention.

A fourth embodiment 140 of the invention is shown in FIG. 14, having a first arm 142 and a second arm 143. This embodiment is similar to the third embodiment except that a first constant or decreasing force spring 1441, is located in a dependent housing 1461 central of a body 141 and a second constant or decreasing force spring 1442 is located in a dependent housing 1462 proximate an outer end of the body 141 into which the first arm 142 telescopes. Moreover, the first spring 1441 has a leading edge connected to an innermost body-located end 149 of the second arm 143. However, the second spring 1442 has a leading edge thereof connected to a shoulder 1421 forming a junction between a main portion of the first arm 142 and a reduced height portion 1412 of the arm 142. As well as producing a compact design similar to that of the third embodiment, the fourth embodiment has the advantage that a force to extend the first arm 142 is not transmitted through a cogwheel 1415 which engages racks on the first arm 142 and the second arm 143 as in the first embodiment. This reduces friction effects and stress on the cogwheel and its axle compared with previous embodiments so that the cogwheel serves merely to ensure the first arm 142 and the second arm 143 are extended and retracted in unison without transmitting any significant force from the first arm 142 to the second arm 143.

Figure 15:
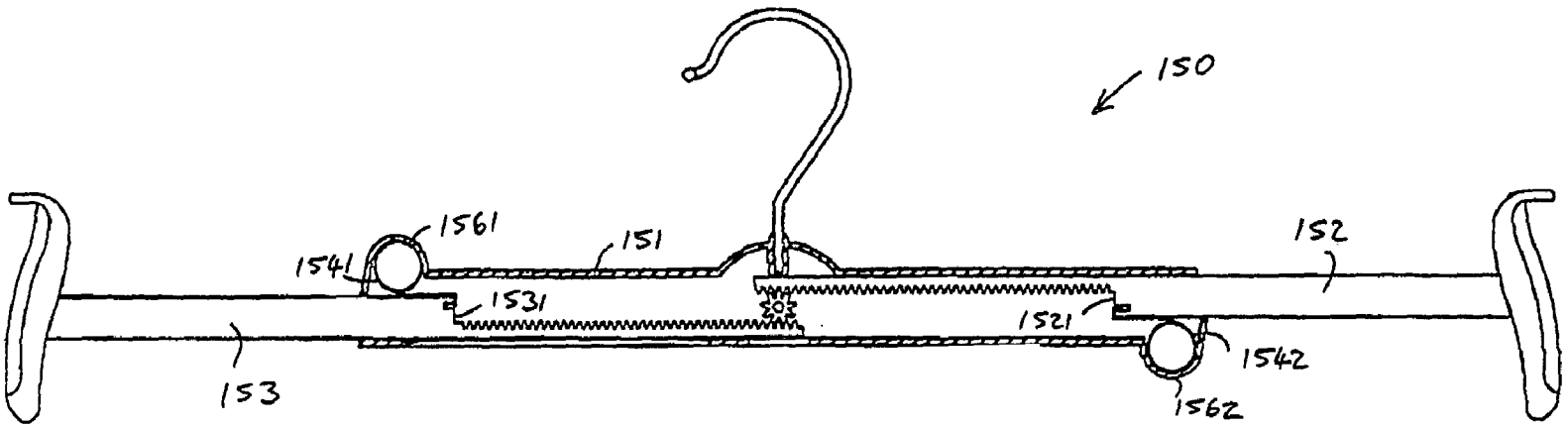
FIG. 15 shows a vertical cross-section view of a fifth embodiment of a garment hanger according to the present invention.

A fifth embodiment 150 of the invention shown in FIG. 15 is similar to the fourth embodiment having a first arm 152 and a second arm 153. However, in the fifth embodiment a first constant or decreasing force spring 1541 is located in a housing 1561 proximate a second end of a body 151 through which the second arm 153 telescopes such that the housing rises from an upper surface of the body 151. A leading edge of the first spring 1541 is joined to a shoulder 1531 of the second arm 153 similar to the shoulder 1421 in the fourth embodiment and a second spring 1542 in a housing 1562 similar to the housing 1462 of the fourth embodiment 140 is connected to a shoulder 1521 on the first arm 152. A tab 1522 is provided on a lower surface of the second arm similar to those of the previous embodiments to prevent the arms being withdrawn from the body once the hanger has been assembled.

Figures 16, 16A, 17:
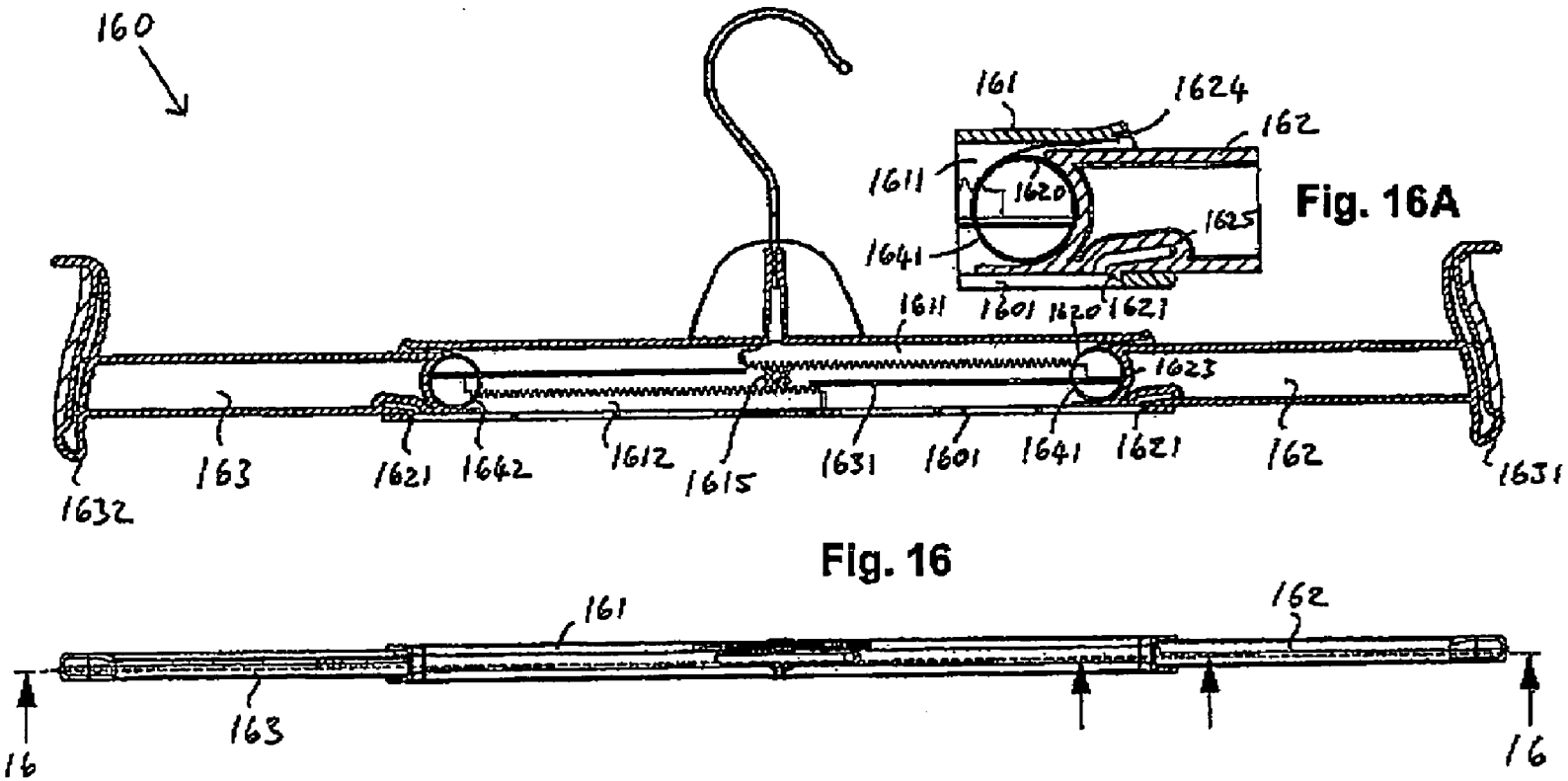
FIG. 16 shows a vertical cross-section view of a sixth embodiment of a garment hanger according to the present invention shown in FIG. 17.
FIG. 16A shows an enlarged cross-section view of a portion of the hanger shown in FIG. 17.
FIG. 17 shows a top view of the garment hanger of FIG. 16.
Figure 18A:
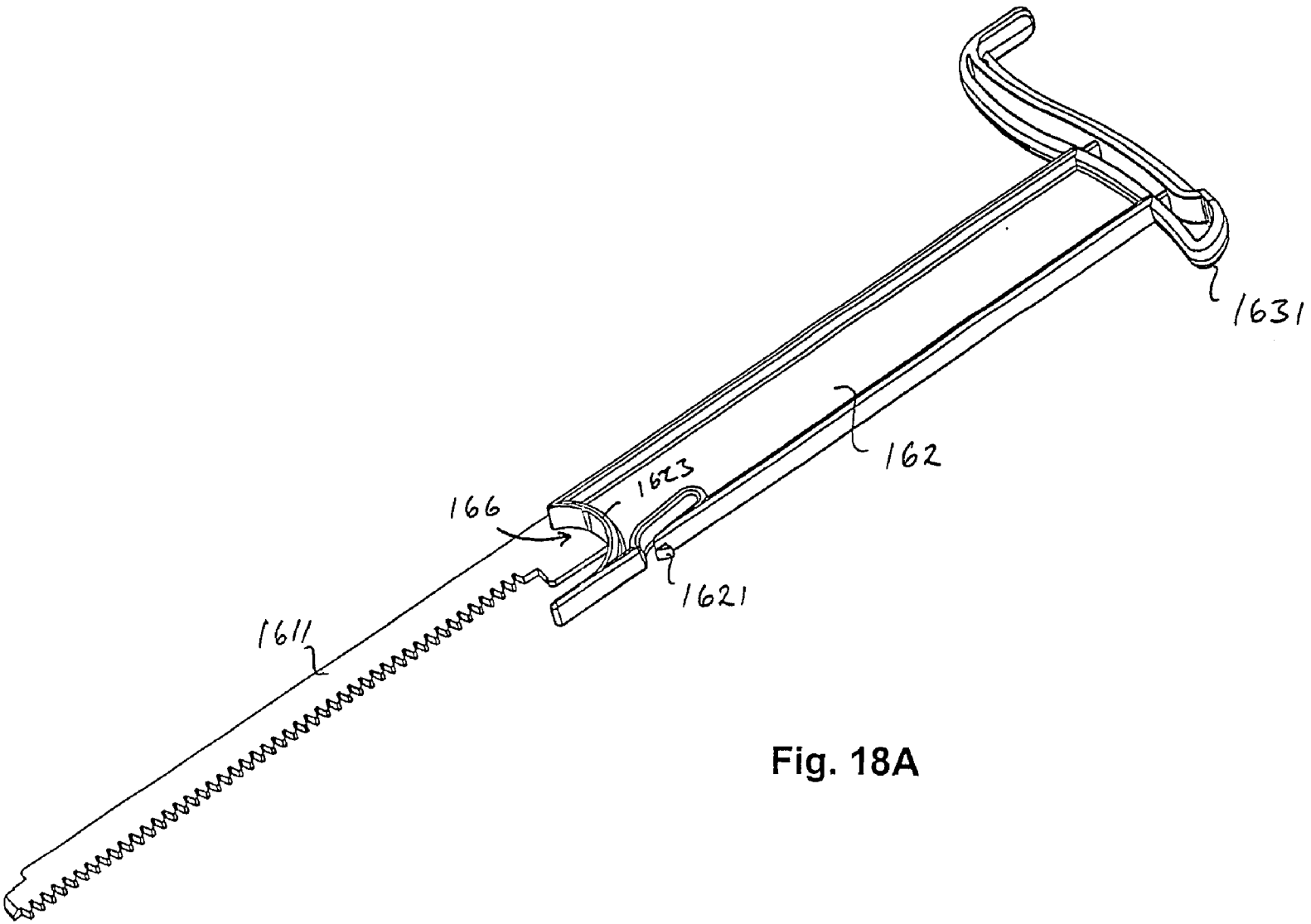
FIG. 18A shows a perspective view of an arm of the hanger of FIG. 16.
Figure 18B:
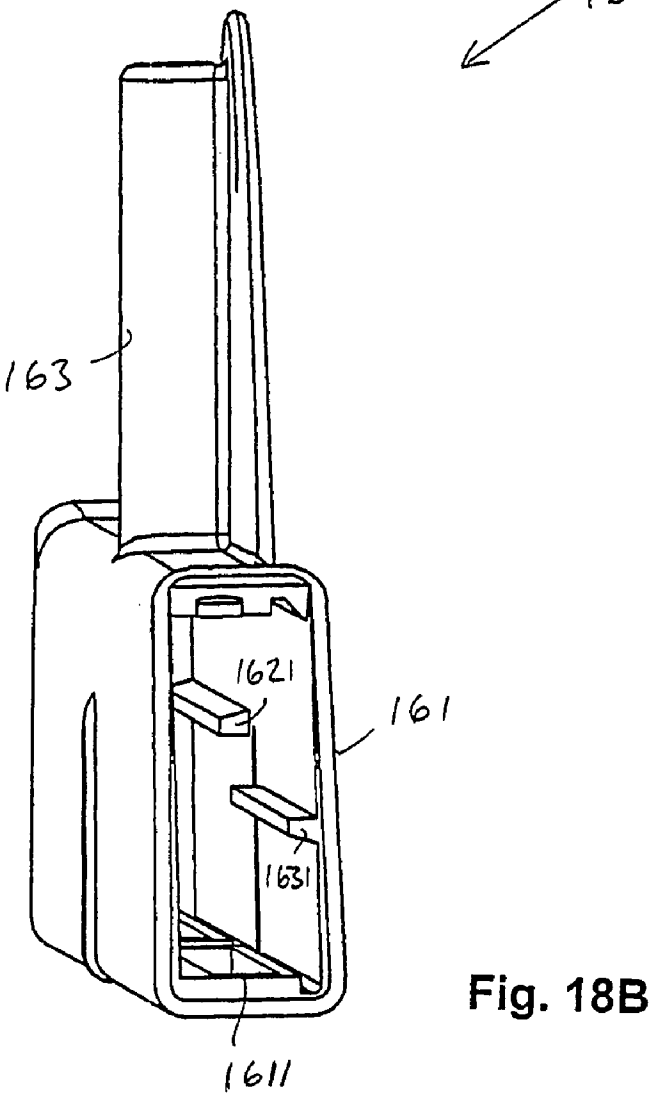
FIG. 18B shows a perspective view of a body of the hanger of FIG. 16.

A sixth embodiment 160 of the invention shown in FIG. 16 has a first arm 162 and a second arm 163. As best shown in FIG. 18A a reduced height portion 1611 of the first arm 162 is transversely off-set from the main portion of the first arm 162 to provide a housing 166 for a first constant or decreasing force spring 1641. As best shown in FIG. 18B the sixth embodiment 160 of the hanger has a body 161 supported by a centrally located hook member 163. The body has a longitudinal axis and generally comprises a main channel of a substantially rectangular cross-section having a slot 1611 along a major portion and central of a lower face of the channel. At least one surface of a major wall of the channel is provided with first and second elongate protrusions 1636,1626 for guiding a reduced height portion 1611 of the first arm 162 and a reduced height portion 1612 of the second arm 163 in a manner to be described. Telescoping into the body 161 along the longitudinal axis are the elongate first arm 162 and the opposed elongate second arm 163. The arms 162,163 are provided at respective ends remote from the body 161 with known garment support members 1631, 1632, inclined at obtuse angles to the longitudinal axis of the hanger 160. As best seen in FIG. 18A, major portions of the arms 162,163 have an I-shaped vertical cross-section to form an easy sliding fit within the body 161. Also located within the body 161 are first and second constant or reducing torque springs 1641,1642 in a manner to be described below.

An embodiment of the invention will now be further described in relation to the first arm 162, the second arm 163, being a mirror image thereof. As shown in FIG. 16, the constant or reducing torque spring 1641 has a first end portion which is coiled into a coiled portion 1620 such that each turn of the coil portion overlaps a preceding turn. The spring has an inner end and an opposed outer end or leading end which is best seen in the insert in FIG. 16 fixed to an upper surface of an end of the body 161 through which the first arm 162 telescopes. An outer leaf of the coiled portion 1620 of the spring 1641 bears on an inner end 1623 of the first arm 162. A substantially linear portion of the spring 1641 is thereby sandwiched between an upper outer face of the first arm 162 and an upper inner face of the channel of the body 161. An indentation 1624 may be provided in the end of the body to accommodate a leading end of the spring 1641. The inner end 1623 of the arm 162 is partially concave in a direction transverse to the longitudinal axis to improve engagement with a convex outer wall of the coiled portion 1620 of the spring 1641.

The first arm 162 is further provided on an underside wall thereof proximate an inner end of the major portion of the arm with a dependent resilient hook 1621 which moves in the channel 1601 as the arm 162 is retracted and extended but engages an end wall of that channel when the arm 162 is at a fully extended position. The hook 1621 is of a sufficiently resilient material than an end of the hook can be retracted into an indentation 1625 in the arm to insert the arm 162 into the body 161 and for an end of the hook to move out of the indentation 1625 in the body when the hook has passed through the closed end of the channel of the body 161. Rather than a hook 1621, a ramp-shaped protrusion may be used on the lower surface of the arm, the lower surface being sufficiently deformable in the vicinity of the ramp-shaped protrusion to allow the arm to be inserted in the body by deflecting the protrusion inward of the arm.

In use, without the garment hanger supporting a garment, the coils of each of the springs 1641 and 1642 bear on respective ends 1623 of the arms 162,163 to urge the arms outwards until the hooks 1621 engage respective ends of the slot 1601 with the arms extended to their fullest extent. To use the hanger to support a garment one or both the arms 162,163 are pushed to telescope both the arms at least partially into the body so that the garment support members 1631,1632 fit, for example, in a waistband of a garment to be suspended. In so doing, the springs are extended i.e. the spring unwinds, thereby exerting substantially constant or reducing force opposing the telescoping of the arms. On releasing the arms, the springs 1641, 1642 wind up thereby urging the arms outwards so that the garment support members 1631,1632 bear on the waistband of the garment to hold the waistband tautly between the garment suspension members 1631,1632. If the spring provides a substantially constant torque as the springs are extended an equal force is supplied by the garment support members to a waistband of the garment whatever the size of the waistband is in the range of the extension of the arms. If, alternatively, the springs are designed to substantially decrease in force as the springs are extended, the garment hanger exerts a greater force on a larger garment than on a smaller garment, this may be desirable where a larger garment is heavier than a smaller garment, so that a larger frictional force is generated at the arm ends to hold the heavier garment than the lighter garment.

As the arms are retracted and extended they move in unison by action of a rotatable cog 1615 acting on racks on reduced height parts 1611,1612 of the arms 162,163 respectively. The reduced height parts 1611,1612 are guided within the body by the longitudinal protrusions 1626,1636 respectively.

A seventh embodiment 190, of the invention shown in FIG. 19 is similar to the sixth embodiment except that instead of reduced height portion 1611,1612 of the sixth embodiment having racks on the lower and upper faces respectively, a reduced height portion 1911 of the first arm 192, and a reduced height portion 1912 of the second arm 193 have racks on opposed vertical faces to engage a cogwheel 1915 therebetween, the cogwheel having a vertical axis as best shown in the insert in FIG. 19. In other major respects and in the basic mode of operation the seventh embodiment is the same as the sixth embodiment.

An eighth embodiment 800 of the invention, shown in FIG. 20, having a first arm 802 and a second arm 803, is similar to the seventh embodiment 190 except that in a similar manner to the third embodiment shown in FIG. 13, each of the constant or decreasing force springs of the sixth or seventh embodiments 1641,1642, 1941,1942 is replaced by a pair of constant or decreasing force springs 8041, 8042 acting in tandem. To accommodate the pairs of springs 8041,8042 a divided housing is provided at an inner end of the major portion of the arms 802,803, so that the portions of the circular faces of each of the coils in a tandem pair of springs bears on a convex surface without bearing on a second spring of the pair of tandem springs. The leading edges of both the springs are hooked to an end of the body into which respective arms telescope.

Figure 21:
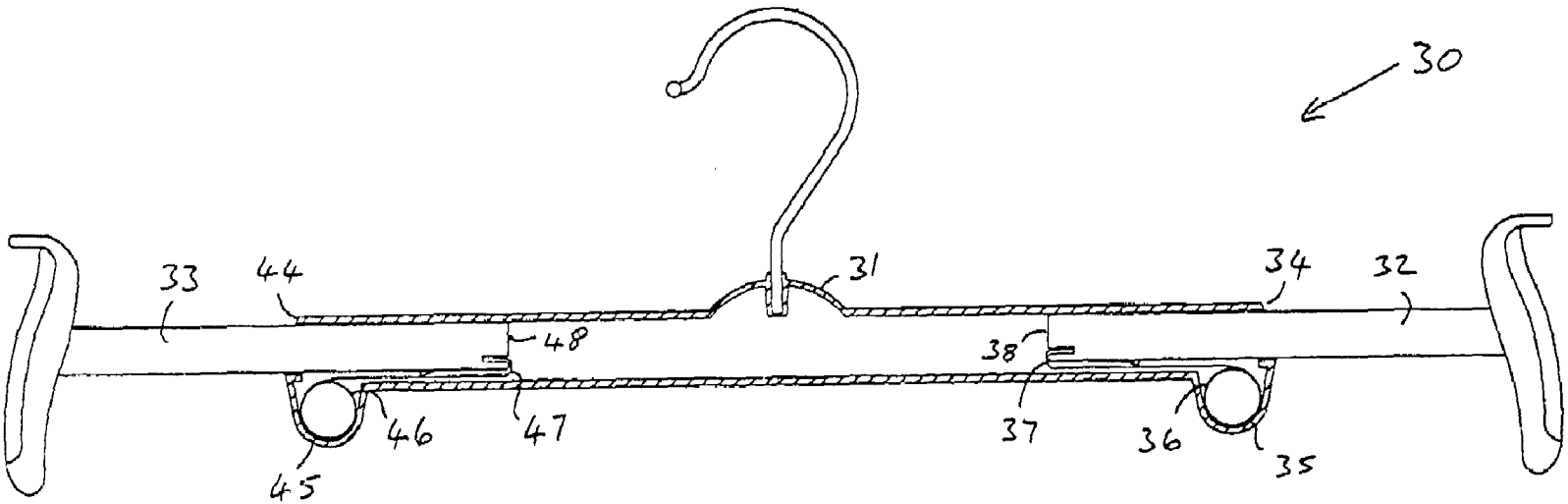
FIG. 21 shows a vertical cross-section view of a ninth embodiment of a garment hanger according to the present invention.

In a ninth embodiment 30 of the invention as shown in FIG. 21, there is provided a body 31 into which are telescopable a first arm 32 and a second arm 33. Dependent from a first end 34 of the body, there is provided a substantially cylindrical chamber 35 housing a constant or decreasing force spring 36. A leading end 37 of the spring 36 is fixed to an inner end 38 of the first arm 32 such that as the spring 36 retracts the spring urges the arm 32 outwards of the body 31. Correspondingly, at an opposed second end 44 of the body, there is provided a second cylindrical housing 45 dependent from the body 31 containing a second constant or decreasing force spring 46 having a leading end 47 acting on an inner end 48 of the second arm 33.

This embodiment operates in a similar manner to the first embodiment, except that the arms 32,33 can be extended and retracted independently of each other. This embodiment has particular applicability where it is not required automatically to maintain the hook central of the body.

Figures 22, 23, 24, 25:
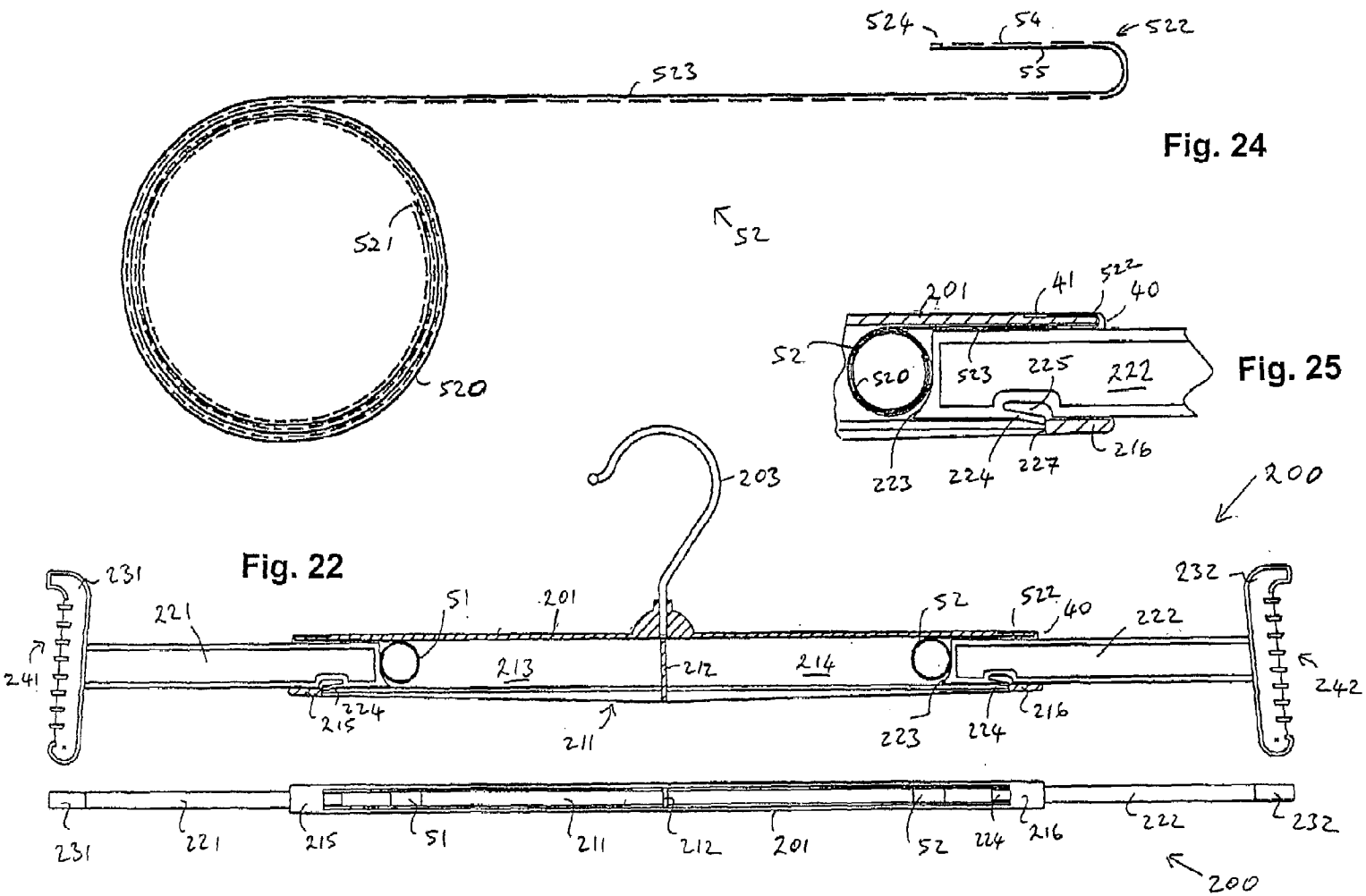
FIG. 22 shows a longitudinal vertical cross-section of a tenth embodiment of a garment hanger according to the present invention.
FIG. 23 shows an underside view of the hanger of FIG. 22.
FIG. 24 shows an enlarged view of a constant torque spring suitable for use in the invention.
FIG. 25 shows in enlarged detail a longitudinal vertical cross-section of the spring of FIG. 24 in use in the hanger of FIG. 22.

Referring to FIGS. 22 to 25 a tenth embodiment 200 of a hanger according to the invention has a body 201 supported by a centrally located hook member 203. The body has a longitudinal axis and is generally of inverted U-shape defining a main channel 211 open at an underside, in use, of the hanger. The main channel 211 is divided centrally by a vertical (as shown in FIG. 22) wall 212 into a first U-shaped channel 213 and a second U-shaped channel 214. The open portions of each of the U-shaped channels 213,214 is closed at an outer end thereof to form a first rectangular channel 215 and second rectangular channel 216 respectively. Telescoping into the body 201 along the longitudinal axis are an elongate first arm 222 and an opposed elongate second arm 221. The arms 221, 222 are provided at respective ends remote from the body 201 with known garment support members 231, 232 having outward facing garment engagement faces 241,242 respectively inclined at obtuse angles to the longitudinal axis of the hanger. The arms 221, 222 have an I-shaped vertical cross-section similar to that shown in FIG. 4, and form an easy sliding fit within the respective channels 213,214. Also located within the channels 213,214 are first and second constant or reducing torque springs 51,52 respectively, to be described below.

The embodiment of the invention will now be further described in relation to the first channel 214, the second channel 213 being a mirror image thereof.

As shown in FIG. 24 the constant or reducing torque spring 52 has a first end portion which is coiled into a coiled portion 520 such that each outer turn of the coiled portion overlaps a preceding turn. The spring has an inner end 521 and an opposed outer end 524 is formed into a U-shaped hook portion 522 joined to the coiled portion 520 by a linear portion 523. The outer end 524 is on an opposed side of the linear portion 523 from the coiled portion 520 so that the coiled portion 520, linear portion 523 and hook portion 522 are substantially coplanar. In equilibrium, in the free state, substantially all of the spring 52 forms the coiled portion 520 and the spring 52 is extendable by increasing the length of the linear portion 523 at the expense of the number of turns of the coiled portion 520.

As best shown in FIG. 24, the spring 52 comprises two separate interleaved lamina 54,55. The lamina are not interconnected, apart from being fixed to each other at an outer end 40 of the body 201 where they are together anchored. The ends of the lamina, at the inner end 521 of the coiled portion 520 are not fixed i.e., are free. As the spring is extended and retracted, the lamina 54,55 slide over each other within the coiled portion 521 to exert a constant or decreasing torque on the hooked portion 522.

It will be understood that more than two such lamina may be used to produce a required constant or reducing torque without exceeding a yield point of the spring.

As best shown in FIG. 25, the hook portion 522, in use, is hooked over the outer end 40 of the body 201 of the hanger and the coiled portion 520 bears on an inner end 223 of the first arm 222. The linear portion 523 is thereby sandwiched between an upper outer face of the first arm 222 and an upper inner face of the first channel 214. An indentation 41 may be provided in the end 40 of the body to accommodate the end 524 of the U-shaped hook portion 522. The inner end 223 of the arm 222 is partially concave in a direction transverse to the longitudinal axis to improve engagement with a convex outer wall of the coiled portion 520 of the spring 52.

The first arm 222 is further provided in an underside wall thereof with a dependent resilient tab 224 proximate the inner end 223 of the arm 222 so that an end of the tab 224 protrudes below a lower edge of the arm 222 to engage an inner end 227 of the rectangular channel 216 to limit outward movement of the arm 222. The tab 224 is of sufficiently resilient material that the end of the tab can be pushed by the rectangular channel 216 into an indentation 225 in a lower (as viewed in FIG. 25) wall of the arm 222 during assembly when the arm is being inserted into the body, and for the end of the tab to move out of the indentation 225 when the tab has passed through the closed channel portion 216.

In use, without the garment hanger supporting a garment, the coils of each of the springs 51,52 bear on respective ends 223 of the arms 221,222 to urge the arms outwards until the tabs 224 engage the end of the rectangular channel portions 215,216 with the arms extended to their fullest extent.

To use the hanger to support a garment, one or both of the arms 221,222 are pushed inwards to telescope the arms at least partially into the body so that the garment support members 231,232 fit, for example, in a waistband of a garment to be suspended. In so doing, the springs are extended i.e. the spring unwinds, thereby exerting a substantially constant or reducing force opposing the telescoping of the arms. On releasing the arms, the springs 51,52 wind up thereby urging the arms outwards so that the garment support members 231,232 bear on the waistband of the garment to hold the waistband tautly between the faces 241,242 of the garment suspension members 231,232. If the springs provide a substantially constant torque as the springs are extended, an equal force is applied by the garment support members to a waistband of a garment whatever the size of the waistband, within the range of the extensions of the arms. If, alternatively, the springs are designed to exert a decreasing force as the springs are extended, the garment hanger will exert a greater force on a larger garment than on a smaller garment. This may be desirable where the larger garment is heavier than the smaller garment, so that a larger frictional force is generated at the arm ends to hold the heavier garment than the lighter garment. It will also be appreciated that there is little likelihood of the coil portions becoming bound within the channel 211.

Although the invention has been described in relation to garment hangers having two arms, the invention is also applicable to a hanger having a single arm telescopable into a body. In such a hanger a garment may be suspendable between a first garment support on the body and a second garment support on the arm. A hook by which the hanger is suspended may be slidable along the body such that the arm is substantially horizontal in use.

The invention claimed is:

1. A garment hanger comprising a body having a longitudinal axis, a movable first arm slidably mounted on the body for free movement with respect to the body substantially along the longitudinal axis, means for applying a resilient force to the first arm to urge the first arm outwards of the body so that the first arm is able to move between a retracted position and an extended position relative to the body wherein the resilient force remains one of substantially constant and increases between the retracted position and the extended position; a second arm mounted on the body for slidable movement along the longitudinal axis in an opposed direction relative to the first arm, wherein the first and second arm each include a respective toothed portion engagable with a common centrally located gear wheel rotatably mounted in the body such that movement of the first arm in a first direction moves the second arm in a second direction opposed to the first direction and the first and second arms move in opposite directions simultaneously.

2. A garment hanger as claimed in claim 1, wherein the means for applying a resilient force to the first arm comprises one of a first constant and decreasing force spring located in the body, wherein a resilient force created by the spring one of remains constant and decreases respectively as the spring is extended.

3. A garment hanger as claimed in claim 1, wherein the first arm includes a first garment-engaging portion located at an outer end of the first arm for supporting a garment thereon.

4. A garment hanger as claimed in claim 3, wherein the second arm includes a second garment-engaging portion located at an outer end of the second arm for supporting the garment by the first garment-engaging portion and the second garment-engaging portion.

5. A garment hanger as claimed in claim 2, wherein the first spring is located in a housing in the body with a leading end of the first spring secured to the first arm such that a tendency of the spring to recoil urges the arm outward of the body.

6. A garment hanger as claimed in claim 1, wherein the gear wheel has an axis substantially perpendicular to at least one of a front and a rear face of the hanger body.

7. A garment hanger as claimed in claim 1, wherein the gear wheel has an axis substantially perpendicular to at least one of a top and bottom face of the hanger body.

8. A garment hanger as claimed in claim 2, wherein one of a second constant and decreasing force spring is arranged to act together on the first arm with the first spring, and the first and second springs are spaced apart in at least one housing in the body.

9. A garment hanger as claimed in claim 2, wherein the hanger is further provided with one of a second constant and decreasing force spring such that the one of a first constant and decreasing force spring acts directly on the first arm and the one of the second constant and decreasing force spring acts directly on the second arm.

10. A garment hanger as claimed in claim 9, wherein the one of the first constant and decreasing force spring is contained in a first housing in the body and the one of the second constant and decreasing force spring is located in a second housing in the body.

11. A garment hanger as claimed in claim 10, wherein the first housing is dependent from a lower face of the body proximate a first end of the body and the second housing is dependent from the lower face of the body proximate a centre of the body.

12. A garment hanger as claimed in claim 10, wherein the first housing is dependent from a lower face of the body proximate a first end of the body and the second housing rises from an upper face of the body proximate an opposed second end of the body.

13. A garment hanger as claimed in claim 2, wherein a leading end of the first spring is anchored to the body and the first spring comprises a coilable portion having a coil axis substantially perpendicular to the longitudinal axis at a second end of the first spring opposed to the leading end, such that the coilable portion bears on an inner end of the first arm to urge the first arm outward of the body.

14. A garment hanger as claimed in claim 13, wherein respective leading ends of first and second one of the constant and decreasing force springs are anchored to the body each spring comprising a coilable portion having a coil axis substantially perpendicular to the longitudinal axis at second ends of the one of the constant and decreasing force springs opposed to the leading ends, such that the coilable portions bear on faces of spaced apart coil housings located in the first arm to urge the first arm outward of the body.

15. A garment hanger as claimed in claim 13, wherein the body comprises a longitudinal channel communicating with an open end of the body for receiving the first arm; such that the first arm is telescopable into the channel and the one of the first constant and decreasing force spring is at least partially located within the channel.

16. A garment hanger as claimed in claim 15, wherein the free end of the one of the first constant and decreasing force spring is connected to the body proximate the open end.

17. A garment hanger as claimed in claim 13, wherein the leading end of the one of the first constant and decreasing force spring comprises hook means for hooking onto the open end.

18. A garment hanger as claimed in claim 17, wherein the hook means is 'U'-shaped.

19. A garment hanger as claimed in claim 13, wherein the inner end of the first arm is at least partially arcuate transversely to said longitudinal axis to receive a convex outer surface of the coilable portion.

20. A garment hanger as claimed in claim 2, wherein the one of the first constant and decreasing force spring comprises a coiled spring in which a number of turns of the spring is dependant on extension of the spring.

21. A garment hanger as claimed in claim 20, wherein leaves of the decreasing force spring are transversely arcuate with varying radius along a length of the spring such that a resilient force exerted by the spring decreases as the spring is extended.

22. A garment hanger as claimed in claim 2, wherein the coilable portion of the one of the first constant and decreasing force spring comprises a plurality of interleaved lamina, the plurality of lamina not being interconnected except insofar that they are anchored to the same location, such that each of the plurality of lamina may slip over a neighbouring lamina as they are coiled and uncoiled.

23. A garment hanger as claimed in claim 14, wherein the second arm is at least a partial mirror image of the first arm.

24. A garment hanger as claimed in claim 1, wherein the body is in two parts, a rear part on which the first and second arms and the means for applying a resilient force are mounted and a front part which is securable to the rear part.

25. A garment hanger as claimed in claim 1, wherein the body has a hook for suspending the garment hanger from a rail.

26. A garment hanger comprising a body having a longitudinal axis, a movable first arm slidably mounted on the body for free movement with respect to the body substantially along the longitudinal axis, one of a first constant and decreasing force spring for applying a resilient force to the first arm to urge the first arm outwards of the body so that the first arm is able to move between a retracted position and an extended position relative to the body wherein the resilient force remains one of substantially constant and increases between the retracted position and the extended position; a second arm mounted on the body for slidable movement along the longitudinal axis in an opposed direction relative to the first arm, wherein the first and second arm each include a respective toothed portion engagable with a common centrally located gear wheel rotatably mounted in the body such that movement of the first arm in a first direction moves the second arm in a second direction opposed to the first direction and the first and second arms move in opposite directions simultaneously, and wherein the hanger is further provided with one of a second constant and decreasing force spring such that the one of a first constant and decreasing force spring acts directly on the first arm and the one of the second constant and decreasing force spring acts directly on the second arm.

27. A garment hanger as claimed in claim 26, wherein the first spring is located in a housing in the body with a leading end of the first spring secured to the first arm such that a tendency of the spring to recoil urges the arm outward of the body.

28. A garment hanger as claimed in claim 26, wherein the one of the first constant and decreasing force spring is contained in a first housing in the body and the one of the second constant and decreasing force spring is located in a second housing in the body.

29. A garment hanger as claimed in claim 28, wherein the first housing is dependent from a lower face of the body proximate a first end of the body and the second housing is dependent from the lower face of the body proximate a centre of the body.

30. A garment hanger as claimed in claim 28, wherein the first housing is dependent from a lower face of the body proximate a first end of the body and the second housing rises from an upper face of the body proximate an opposed second end of the body.

31. A garment hanger as claimed in claim 26, wherein a leading end of the first spring is anchored to the body and the first spring comprises a coilable portion having a coil axis substantially perpendicular to the longitudinal axis at a second end of the first spring opposed to the leading end, such that the coilable portion bears on an inner end of the first arm to urge the first arm outward of the body.

32. A garment hanger as claimed in claim 31, wherein respective leading ends of first and second one of the constant and decreasing force springs are anchored to the body each spring comprising a coilable portion having a coil axis substantially perpendicular to the longitudinal axis at second ends of the one of the constant and decreasing force springs opposed to the leading ends, such that the coilable portions bear on faces of spaced apart coil housings located in the first arm to urge the first arm outward of the body.

33. A garment hanger as claimed in claim 31, wherein the body comprises a longitudinal channel communicating with an open end of the body for receiving the first arm; such that the first arm is telescopable into the channel and the one of the first constant and decreasing force spring is at least partially located within the channel.

34. A garment hanger as claimed in claim 33, wherein the free end of the one of the first constant and decreasing force spring is connected to the body proximate the open end.

35. A garment hanger as claimed in claim 31, wherein the leading end of the one of the first constant and decreasing force spring comprises hook means for hooking onto the open end.

36. A garment hanger as claimed in claim 35, wherein the hook means is 'U'-shaped.

37. A garment hanger as claimed in claim 31, wherein the inner end of the first arm is at least partially arcuate transversely to said longitudinal axis to receive a convex outer surface of the coilable portion.

38. A garment hanger as claimed in claim 26, wherein the one of the first constant and decreasing force spring comprises a coiled spring in which a number of turns of the spring is dependant on extension of the spring.

39. A garment hanger as claimed in claim 31, wherein leaves of the decreasing force spring are transversely arcuate with varying radius along a length of the spring such that a resilient force exerted by the spring decreases as the spring is extended.

40. A garment hanger as claimed in claim 26, wherein the coilable portion of the one of the first constant and decreasing force spring comprises a plurality of interleaved lamina, the plurality of lamina not being interconnected except insofar that they are anchored to the same location, such that each of the plurality of lamina may slip over a neighbouring lamina as they are coiled and uncoiled.

* * * * *